US006526607B2

(12) United States Patent
Shillam et al.

(10) Patent No.: US 6,526,607 B2
(45) Date of Patent: Mar. 4, 2003

(54) BASKET BED FOR AN INFANT

(76) Inventors: Violette M. Shillam, 16428 15th Ct., SE., Mill Creek, WA (US) 98012; William L. Freeman, III, 102 Cranberry Way, Easley, SC (US) 29642-3200

( * ) Notice: Subject to any disclaimer, the term of this patent is extended or adjusted under 35 U.S.C. 154(b) by 0 days.

(21) Appl. No.: 10/074,553

(22) Filed: Feb. 12, 2002

(65) Prior Publication Data

US 2003/0014815 A1 Jan. 23, 2003

Related U.S. Application Data

(60) Provisional application No. 60/306,650, filed on Jul. 19, 2001.

(51) Int. Cl.[7] ..... A47D 13/02

(52) U.S. Cl. ..... 5/93.1; 5/94; 150/100; 190/2; 220/9.1; 220/495; 294/140

(58) Field of Search ..... 5/93.1, 94, 98.1, 5/655; 294/140; 220/495, 9.1; 150/100; 190/2

(56) References Cited

U.S. PATENT DOCUMENTS

| | | | | |
|---|---|---|---|---|
| 388,425 A | * | 8/1888 | Little | |
| 2,551,509 A | | 5/1951 | Smith | 5/98.1 |
| 3,096,917 A | | 7/1963 | Gudiksen | 5/98.1 |
| D200,759 S | | 4/1965 | Caswell | D5/5 |
| 4,365,658 A | | 12/1982 | Stevens | 150/48 |
| D268,217 S | | 3/1983 | Stevens | D34/42 |
| D272,015 S | | 1/1984 | Black | D3/31 |
| 4,717,056 A | | 1/1988 | Carmichael | 244/158 |
| D333,599 S | | 3/1993 | Wojtkiewicz | D3/31 |
| D400,703 S | | 11/1998 | Cabagnero | D3/213 |
| D426,706 S | * | 6/2000 | Winderl | |

* cited by examiner

*Primary Examiner*—Alexander Grosz
(74) *Attorney, Agent, or Firm*—Dean A. Craine

(57) ABSTRACT

A lightweight, soft-sided, oval basket for use as a portable infant bed. The basket bed includes a basket body made with a continuous coil material produced by encasing a monofilament nylon cord and filler material in a fabric tube or casing. A decorative braiding stitch wraps around the coil material to provide support. Starting at the center of the bottom panel of the basket body, the coil material is spiraled concentrically outward and then upward to form an elongated oval basket body. The adjacent rows of the coil material are joined with transparent, nylon zigzag machine stitching. The coil material is used to produce handles which are formed along the top, center sections of the side walls. An optional lightweight rigid support member is placed over the top surface of the bottom member to provide additional support thereto. An optional mattress is also provided that fits inside the basket and over the support member.

8 Claims, 4 Drawing Sheets

BASKET BED FOR AN INFANT

This is a utility patent application based on a provisional patent application (Serial No. 60/306,650) filed on Jul. 19, 2001.

BACKGROUND OF THE INVENTION

1. Field of the Invention

This invention pertains to baskets and, more particularly, to baskets which are intended to be used as portable beds for infants.

2. Description of the Related Art

Lightweight, portable basket-style infant beds, historically known as Moses baskets, have existed for thousands of years. Traditionally, these baskets have been woven from wicker or straw and include side handles for portability. A major problem with these baskets is that they begin to loose their shape as the side walls of the basket begin to splay outward or fold inward. Also, the wicker or straw material used in their construction is too rough for infants to rub against or touch.

Accordingly, there is a need for a basket-style infant bed that retains the economical and portable qualities of the traditional Moses basket, yet offers a more durable structure and is more comfortable and practical to use.

SUMMARY OF THE INVENTION

It is an object of the present invention to provide a lightweight basket with carrying handles designed to be used as a portable bed for an infant.

It is another object of the present invention to provide such a basket with sufficiently tall side walls that resist folding inward or outward.

It is another object of the present invention to provide such a basket that is hand-washable, soft, comfortable, safe, and secure.

It is a further object of the invention to provide such a basket that is relatively inexpensive to manufacture.

These and other objects of the invention which will become apparent are met by the basket bed for an infant disclosed herein comprising a basket body having a flat bottom member, continuous perimeter oval-shaped side walls and two integrally formed handles. The bottom member, continuous perimeter side wall, and two handles are all formed from continuous coil material that is spiraled concentrically from the center of the bottom member outward and then upward along the side walls to form an elongated oval structure with a top opening. The coil material is formed by encasing a monofilament cord and non-woven fiber filling in a fabric outer casing. A decorative braiding stitch wraps around and secures the coil material, thereby giving the basket a braided basket appearance. The adjacent spirals or rows of coil material are attached together with transparent, nylon zigzag stitching. The cord used inside the coil material provides sufficient support so that the side walls retain their upright orientation. In the preferred embodiment, the two handles are transversely aligned over the basket body. Disposed over the bottom member are an optional rigid panel and mattress.

DESCRIPTION OF THE PREFERRED EMBODIMENT(S)

Figure 1:
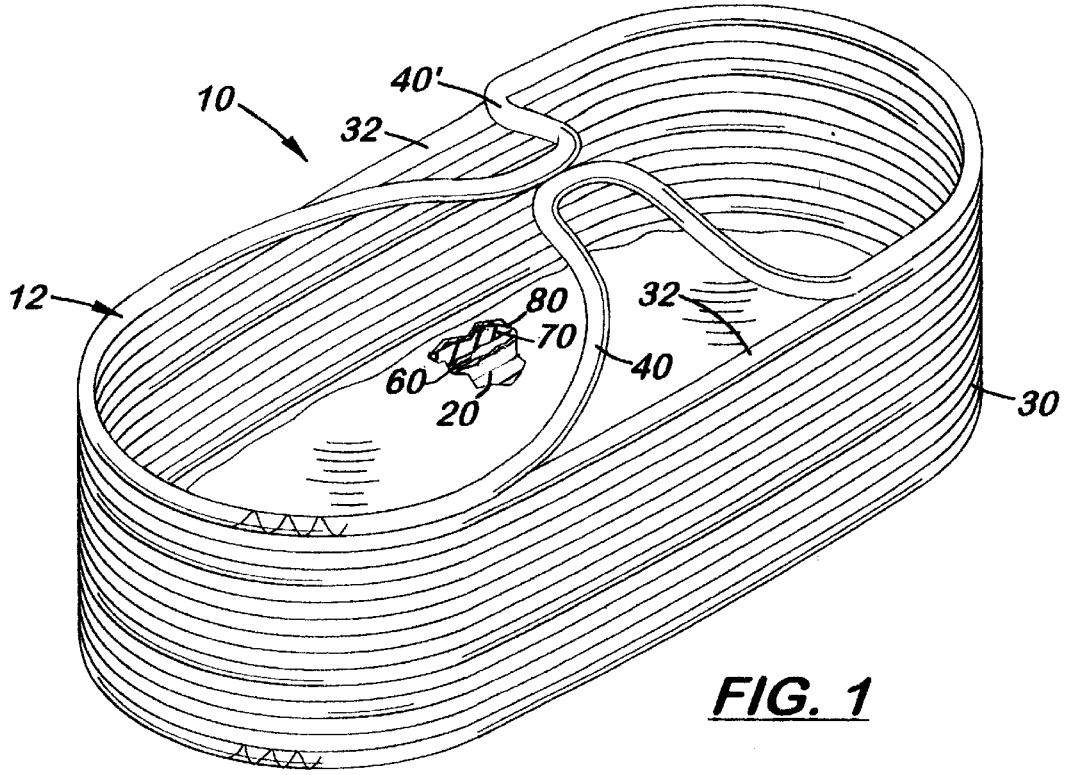
FIG. 1 is a perspective view of the basket bed for an infant disclosed herein.
Figure 2:
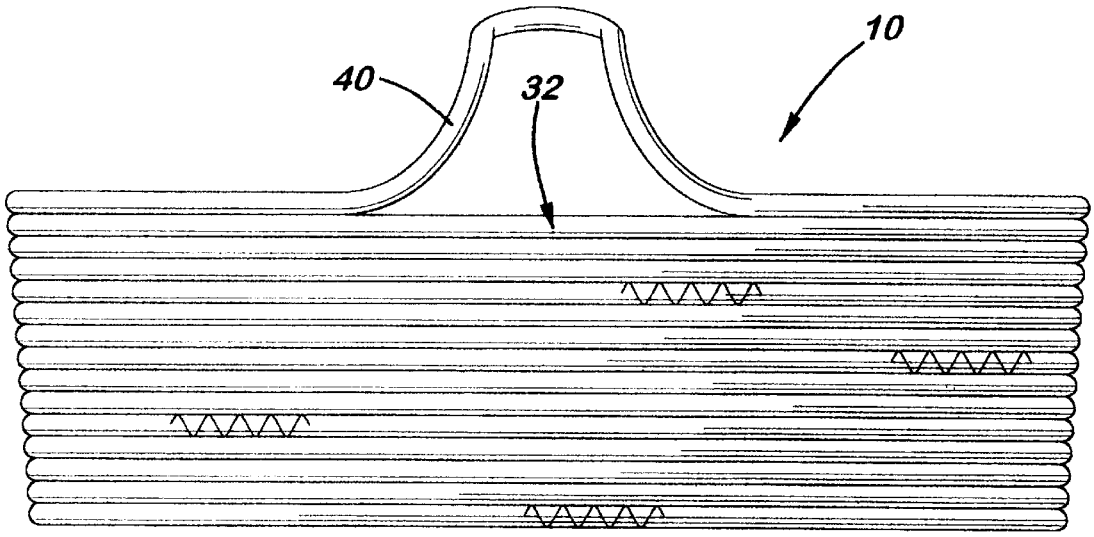
FIG. 2 is a right side elevational view of the invention.

Referring to the accompanying FIGS. 1–8, there is shown and described a basket bed 10 for an infant comprising a basket body 12 with a flat bottom member 20, continuous perimeter side walls 30, and two integrally formed handles 40, 40'. Disposed inside the basket body 12 are an optional support member 60 and an optional mattress 70. The bottom member 20, side walls 30, and handles 40, 40' are made of one continuous coil material 50. The coil material 50 is comprised of a continuous strip of washable fabric 52, such as cotton or cotton/polyester blend, which is longitudinally wrapped around a continuous length of pliable stiffener 54, such as a monofilament cord, and a soft, non-woven filler 56. Decorative braided stitching 58 wraps around the fabric 52 to enclose the fabric 52 around the stiffener 54 and filler 56 to create a continuous tube-like structure.

Figure 3:
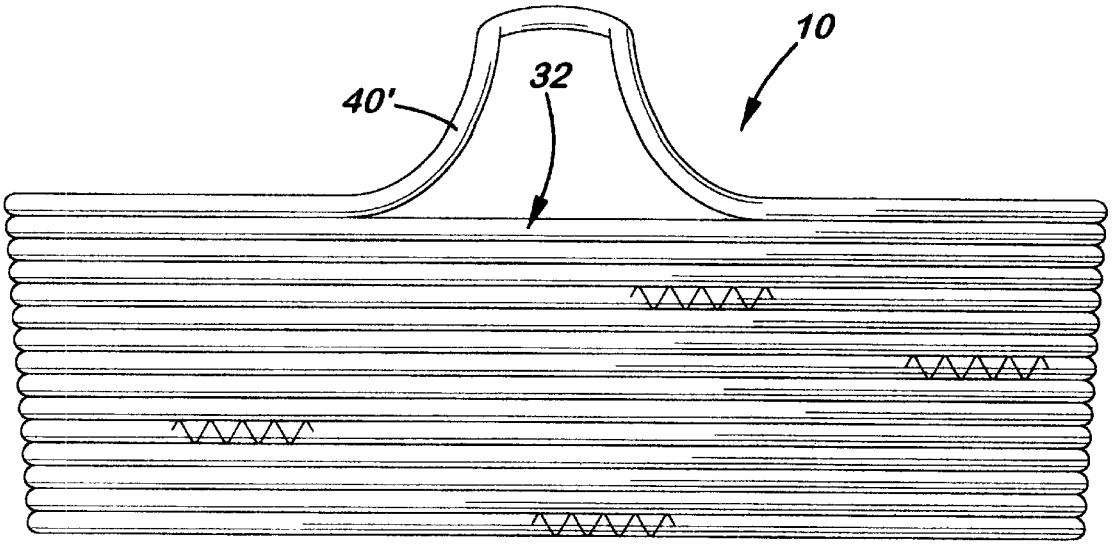
FIG. 3 is a left side elevational view of the invention.
Figure 4:
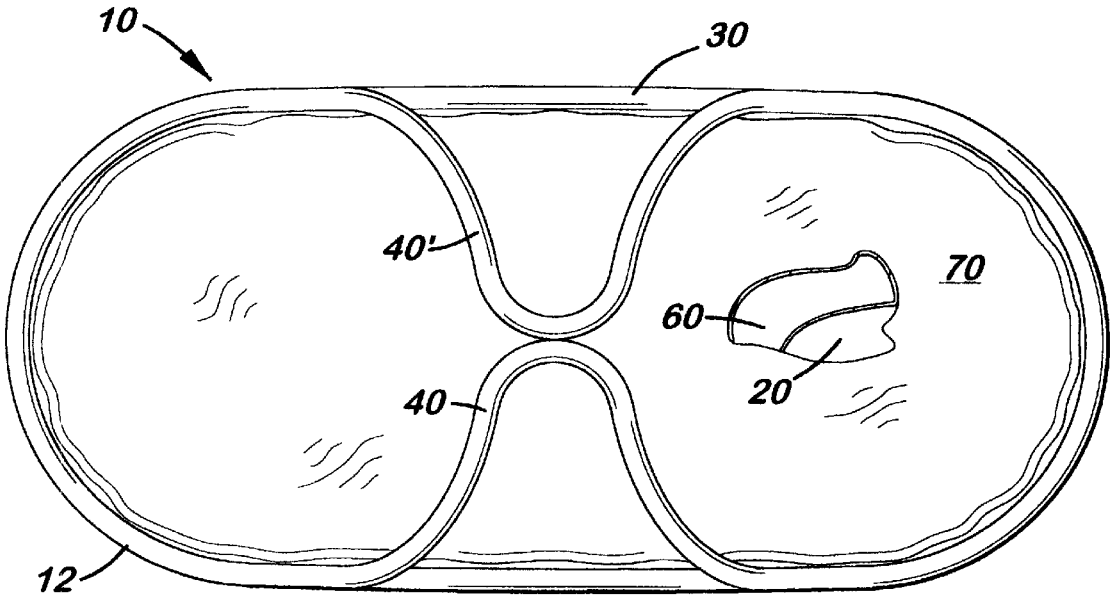
FIG. 4 is a top plan view of the invention.
Figure 5:
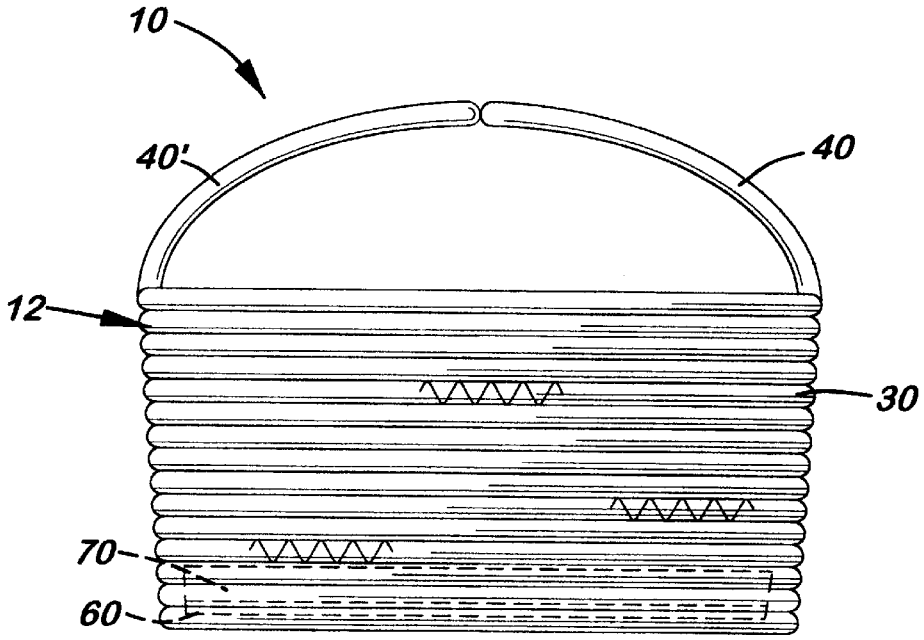
FIG. 5. is an end elevational view of the invention.
Figure 6:
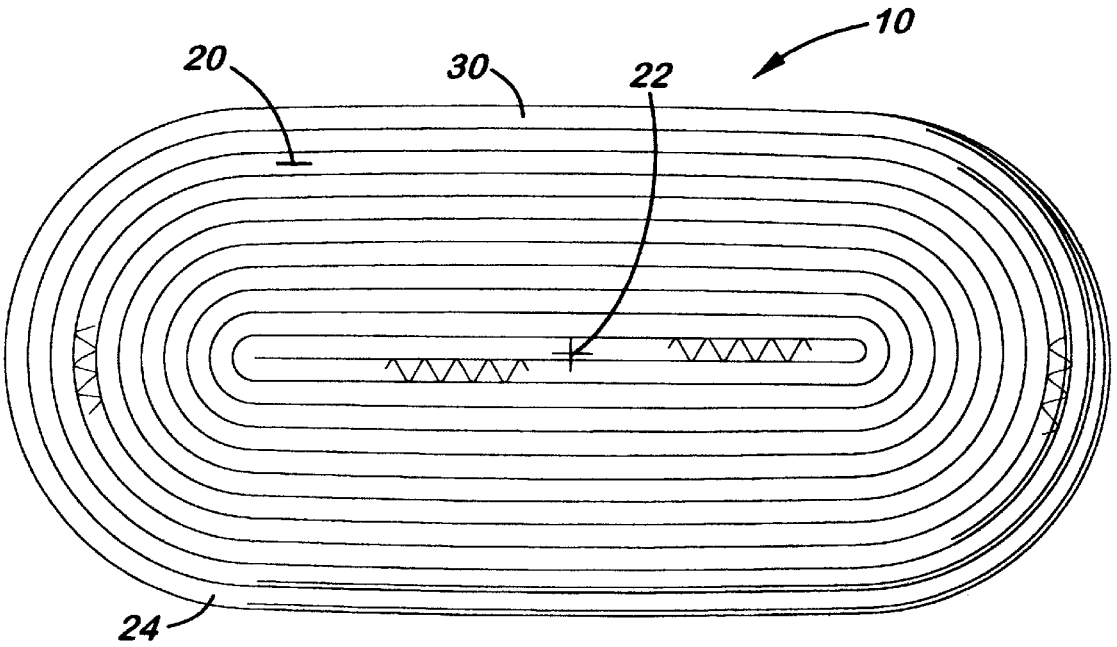
FIG. 6. is a bottom plan of the invention.
Figure 7:
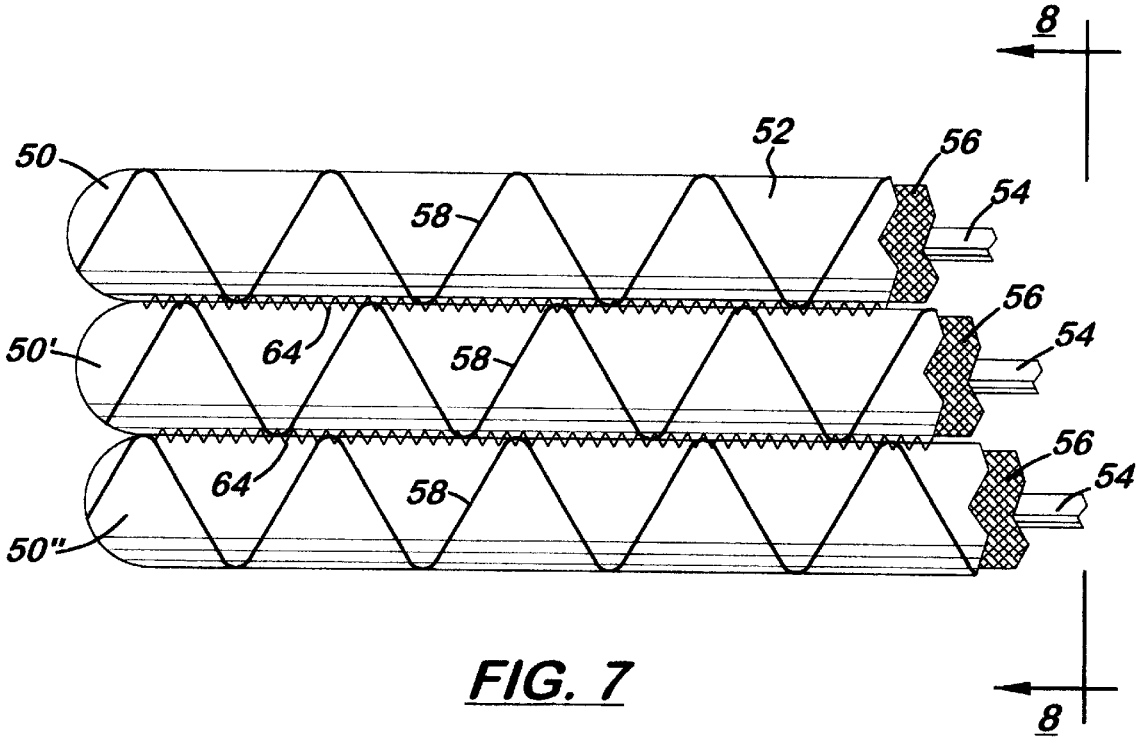
FIG. 7 is a sectional side elevational view of the invention.
Figure 8:
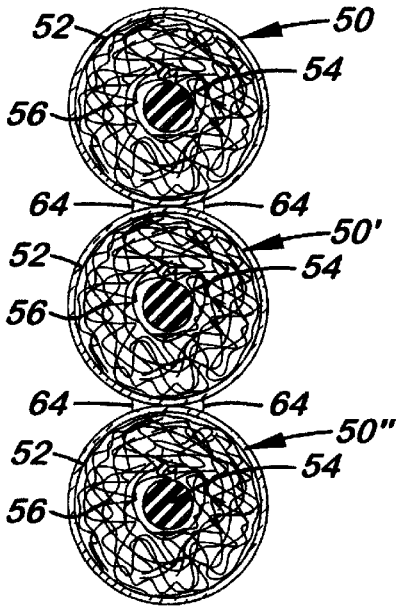
FIG. 8 is a sectional end elevational view of the invention taken from along line 8—8 in FIG. 7.

As shown in FIG. 6, the coil material 50 is spiraled concentrically from the bottom member 20 center axis 22 outward to form a flat, oval bottom member 20. At the outside edge 24 of the bottom member 20, the coil material 50 is spiraled upward to form adjacent rows on the side walls 30. As shown in FIG. 7, adjacent rows of the coil material 50, 50', 50" on the bottom member 20 and side walls 30 are attached using high tenacity, monofilament thread zigzag machine stitching 64. As shown in FIGS. 1 and 3, two handles 40, 40' are formed along the top of the side walls 30 when the top row of the coil material 50 is left unattached along the center section 32 of each side wall 30.

The optional support member 60 is disposed inside the basket body 12 and is intended to provide additional support to carry an infant weighing up to 17 pounds. In the preferred embodiment, the support member 60 is made of a rigid plastic laminate material approximately 3/16 inches in thickness or hardboard 1/8 inch in thickness. Disposed over the support member 60 is an optional mattress 70 which is encased in a water-resistant covering 80. The support member 60 may be placed inside the water-resistant covering 80.

In the present embodiment, the basket body 12 is intended to carry an infant weighing up to 17 pounds. The basket body 12 measures approximately 28 inches in length by 15 inches in width and 9 inches in height. The continuous coil material 50 measures approximately 54 yards in length and ½ inch in diameter. The fabric 52 is approximately three inches in width. The monofilament cord stiffener 54 measures approximately 0.065 to 0.085 inches in diameter. The high tenacity monofilament thread used for the zigzag machine stitching 64 is made of nylon and is approximately 0.010 to 0.022 inches in diameter. The support member 60 is oval in shape and substantially covers the entire top surface of the bottom member 20. The mattress 70 substantially covers the entire top surface of the support member 60 and measures approximately one inch in depth.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

We claim:

1. A basket bed for an infant comprising a basket body made of a continuous coil material that includes a continuous tube made of fabric and filled with a filler material and a stiffener, said coil material being disposed in rows sewn together to form a basket body with continuous perimeter side walls and a flat bottom panel.

2. The basket bed for an infant, as recited in claim, 1, further including a support member disposed over said bottom panel to provide support thereto.

3. The basket bed for an infant, as recited in claim 1, further including a pair of side handles made of said continuous coil material.

4. The basket bed for an infant, as recited in claim 3, wherein said handles are formed on opposite side walls of said basket body.

5. The basket bed for an infant, as recited in claim 1, wherein said stiffener is a continuous nylon monofilament.

6. The basket bed for an infant, as recited in claim 1, wherein said basket is oval in shape and measures approximately 28 inches in length by 15 inches in width and 9 inches in height.

7. The basket bed for an infant, as recited in claim 1, wherein said coil material is wrapped with a braided stitch.

8. The basket bed for an infant, as recited in claim 7, wherein adjacent rows of said coil material are sewn together with suitable thread.

* * * * *